US008617034B2

(12) United States Patent
Eem

(10) Patent No.: US 8,617,034 B2
(45) Date of Patent: Dec. 31, 2013

(54) ROTARY TYPE PUNCHING EXERCISER

(76) Inventor: Dong Kiu Eem, Incheon Metropolitan (KR)

( * ) Notice: Subject to any disclaimer, the term of this patent is extended or adjusted under 35 U.S.C. 154(b) by 421 days.

(21) Appl. No.: 13/123,131

(22) PCT Filed: Jan. 31, 2011

(86) PCT No.: PCT/KR2011/000655
§ 371 (c)(1),
(2), (4) Date: Apr. 7, 2011

(87) PCT Pub. No.: WO2011/102612
PCT Pub. Date: Aug. 25, 2011

(65) Prior Publication Data

US 2012/0129660 A1 May 24, 2012

(30) Foreign Application Priority Data

Feb. 17, 2010 (KR) ..... 20-2010-0001671 U
May 31, 2010 (KR) ..... 20-2010-0005684 U

(51) Int. Cl.
*A63B 69/34* (2006.01)
*A63B 69/28* (2006.01)

(52) U.S. Cl.
USPC ..... 482/83; 482/87; 482/90

(58) Field of Classification Search
USPC ..... 482/83–90
See application file for complete search history.

(56) References Cited

U.S. PATENT DOCUMENTS

| | | | | | |
|---|---|---|---|---|---|
| 1,890,696 | A * | 12/1932 | Rosenhahn | 482/90 |
| 2,435,864 | A * | 2/1948 | Adams | 482/90 |
| 2,625,356 | A * | 1/1953 | Kennedy et al. | 248/121 |
| 3,022,072 | A * | 2/1962 | Zinnow | 482/90 |
| 4,084,811 | A * | 4/1978 | Kyo | 482/83 |
| 4,564,192 | A * | 1/1986 | Lebowitz | 482/87 |
| 5,046,724 | A * | 9/1991 | Sotomayer | 482/90 |
| 5,352,170 | A * | 10/1994 | Condo et al. | 482/83 |
| 5,389,057 | A * | 2/1995 | Zagata, Jr. | 482/83 |
| 5,899,835 | A * | 5/1999 | Puranda | 482/90 |
| 7,147,579 | B2 * | 12/2006 | Forrest | 473/441 |
| 7,704,194 | B1 * | 4/2010 | Chen | 482/87 |
| 7,828,701 | B1 * | 11/2010 | Chen | 482/83 |
| 7,862,485 | B2 * | 1/2011 | Luigi | 482/89 |

* cited by examiner

*Primary Examiner* — Stephen Crow
(74) *Attorney, Agent, or Firm* — Novick, Kim & Lee, PLLC; Jae Youn Kim

(57) ABSTRACT

A rotary type punching exerciser is disclosed. The rotary type punching exerciser includes a punchball, a support arm to support the punchball, the support arm being adjustable in length in a direction in which one end of the support arm extends, to enable adjustment of a punching cycle of the punchball, a support bar to support the other end of the support arm such that the support arm is rotatable by 360 degrees, the support bar being adjustable in length in a vertical direction, to enable adjustment of a punching height of the punchball, and a pedestal to support the support bar. With the use of the rotary type punching exerciser, a user can anticipate a movement path of the punchball, which allows the user to easily successively punch the punchball.

12 Claims, 6 Drawing Sheets

ROTARY TYPE PUNCHING EXERCISER

BACKGROUND OF THE INVENTION

1. Field of the Invention

The present invention relates to a rotary type punching exerciser.

2. Description of the Related Art

A conventionally used punching ball apparatus is comprised of a punchball and an elastic member to elastically support the punchball. Here, the elastic member may extend in a vertical direction of the punchball and be mounted to the ceiling or floor of a room.

However, when using the punching ball apparatus, a user has difficulty successively punching the punchball returned after punching the punchball with his/her fist. This is because the punchball has a very short resilience cycle due to strong elastic restoration force of the elastic member supporting the punchball and the punchball supported by the vertically extending elastic member makes it difficult for the user to estimate a return position of the punchball.

That the user cannot successively punch the returned punchball after initially punching the punchball is liable to break a user's exercise rhythm and causes the user to feel the stress during exercise rather than arousing a user's interest. For these reasons, the punching ball apparatus has difficulty being used by all people without distinction of age or sex.

Although now attention is being focused on such a punching ball apparatus as an understanding that boxing is an exercise useful in relieving stress or dieting is expanding, most punching ball apparatuses have a limit in propagation because of high costs required to install the elastic member used to elastically support the punchball.

SUMMARY OF THE INVENTION

Therefore, the present invention has been made in view of the above problems, and it is an object of the present invention to provide a rotary type punching exerciser that can be used even by a beginner.

In accordance with the present invention, the above and other objects can be accomplished by the provision of a rotary type punching exerciser including a punchball, a support arm to support the punchball, the support arm being adjustable in length in a direction in which one end of the support arm extends, to enable adjustment of a punching cycle of the punchball, a support bar to support the other end of the support arm such that the support arm is rotatable by 360 degrees, the support bar being adjustable in length in a vertical direction, to enable adjustment of a punching height of the punchball, and a pedestal to support the support bar.

The support arm may be rotatably coupled to the support bar. The rotary type punching exerciser may further include an elastic support unit to elastically support the support arm in a direction in which the support bar extends.

The elastic support unit may include support plates coupled to upper and lower positions of the support bar with the support arm interposed therebetween, an elastic member interposed between each support plate and the other end of the support arm, a bearing interposed between the other end of the support arm and the support bar, and a washer interposed between the elastic member and the support arm.

The other end of the support arm may be provided with a rotation ring into which the support bar is inserted, and both ends of the support arm may be separably coupled to the punchball and the rotation ring.

The support arm may be elastically flexible. The support arm may include a plurality of first connection pipes coupled to each other in a telescopic manner, and the support bar may include a plurality of second connection pipes coupled to each other in a telescopic manner.

The pedestal may internally define a receptacle in which a weight is accommodated. The rotary type punching exerciser may further include a mounting member coupled to a lower surface of the pedestal, and the mounting member may include a pair of Velcro straps interposed between the pedestal and the floor on which the rotary type punching exerciser is installed.

In accordance with another aspect of the present invention, there is provided a rotary type punching exerciser including a punchball, a support arm to support the punchball, a support bar to support the support arm such that the support arm is rotatable by 360 degrees, a pedestal to support the support bar, and an elastic support unit to elastically support the support arm in a direction in which the support bar extends.

The support arm may be adjustable in length in a direction in which the support arm extends, to enable adjustment of a punching cycle of the punchball. The support bar may be adjustable in length in a vertical direction, to enable adjustment of a punching height of the punchball.

The elastic support unit may include support plates coupled to upper and lower positions of the support bar with the support arm interposed therebetween, an elastic member interposed between each support plate and one end of the support arm, a bearing interposed between the other end of the support bar and the support bar, and a washer interposed between the elastic member and the support arm.

In accordance with a further aspect of the present invention, there is provided a rotary type punching exerciser including a punchball, a support arm to support the punchball, a support bar to support the support arm such that the support arm is rotatable by 360 degrees, a pedestal to support the support bar, and an adjustor to adjust a rotation cycle of the support arm about the support bar, to enable adjustment of a punching cycle of the punchball.

The rotary type punching exerciser may further include an elastic support unit to elastically support the support arm in a direction in which the support bar extends. The elastic support unit may include support plates coupled to upper and lower positions of the support bar with the support arm interposed therebetween, an elastic member interposed between each support plate and one end of the support arm, and a washer interposed between the elastic member and the support arm.

The end of the support arm may be provided with a rotation ring, into which the support bar is inserted, and the adjustor may include an adjusting screw fastened to the support bar so as to press the support plate toward the rotation ring.

The support arm may be adjustable in length in a direction in which one end of the support arm extends, to enable adjustment of a punching cycle of the punchball. The support bar may be adjustable in length in a vertical direction, to enable adjustment of a punching height of the punchball.

BRIEF DESCRIPTION OF THE DRAWINGS

The above and other objects, features and other advantages of the present invention will be more clearly understood from the following detailed description taken in conjunction with the accompanying drawings, in which.

DETAILED DESCRIPTION OF THE INVENTION

Figure 1:
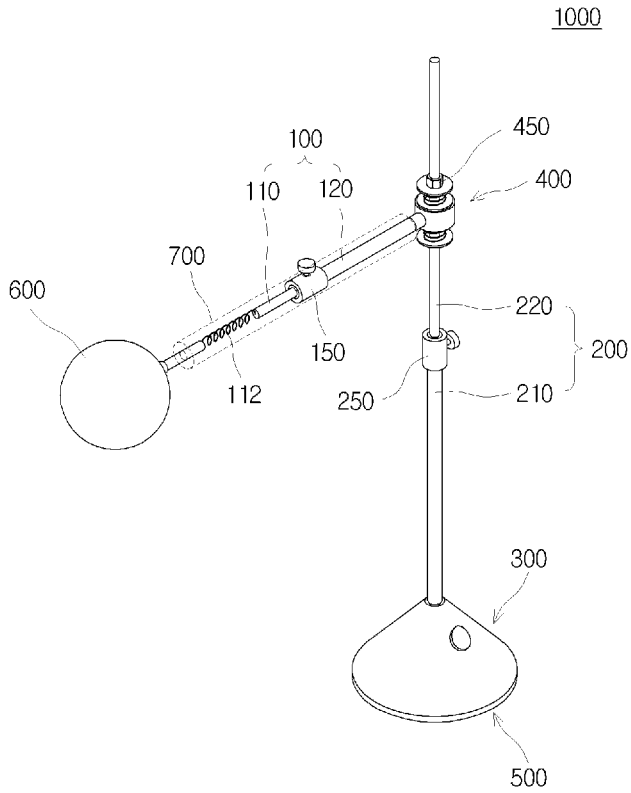
FIG. 1 is a perspective view illustrating a rotary type punching exerciser according to an embodiment of the present invention.

Now, particular embodiments of the present invention will be illustrated in the drawings and described in detail hereinafter. However, it should be understood that there is no intent to limit the invention to the particular forms disclosed, but on the contrary, the invention is to cover all modifications, equivalents, and alternatives falling within the spirit and scope of the invention as defined by the claims. In the following description of the present invention, a detailed description of known functions and configurations incorporated herein will be omitted when it may make the subject matter of the present invention rather unclear.

It will be understood that, although the terms first, second, etc. may be used herein to describe various elements, these elements should not be limited by these terms. These terms are used simply to discriminate any one element from other elements.

The terminology used herein is for the purpose of describing particular example embodiments only and is not intended to be limiting. As used herein, the singular forms "a," "an," and "the" are intended to include the plural forms as well, unless the context clearly indicates otherwise. It will be further understood that the terms "comprises," "comprising," "includes," and/or "including," when used in this specification, specify the presence of stated features, integers, steps, operations, elements, and/or components, but do not preclude the presence or addition of one or more other features, integers, steps, operations, elements, and/or components.

Hereinafter, preferred embodiments of a rotary type punching exerciser according to the present invention will be described in detail with reference to the accompanying drawings. In the drawings, the same or similar elements are denoted by the same reference numerals even though they are depicted in different drawings, and a repeated description thereof will be omitted.

Figure 2:
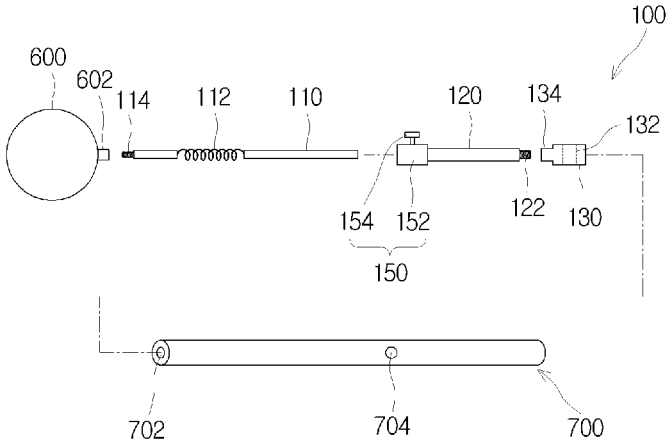
FIG. 2 is a front view illustrating a punchball and a support arm of the rotary type punching exerciser according to the embodiment of the present invention.

FIG. 1 is a perspective view illustrating a rotary type punching exerciser 1000 according to an embodiment of the present invention, and FIG. 2 is a front view illustrating a punchball 600 and a support arm 100 of the rotary type punching exerciser 1000 according to the embodiment of the present invention.

As illustrated in FIGS. 1 and 2, the rotary type punching exerciser 1000 according to the embodiment of the present invention includes the punchball 600, the support arm 100, a support bar 200, an elastic support unit 400, a pedestal 300, and a mounting member 500.

The punchball 600 may take the form of an elastic sphere, the interior of which is charged with air. The punchball 600 is provided at one side thereof with a nut 602, which may be screwed to a bolt 114 provided at one end of the support arm 100 which will be described hereinafter. As such, the punchball 600 and the support arm 100 may be separably fastened to each other.

The support arm 100 functions to support the punchball 600. The support arm 100 may be longitudinally elongated and be arranged in a horizontal direction perpendicular to the support bar 200 which will be described hereinafter. Thus, if a user punches the punchball 600, the support arm 100 is rotated about the support bar 200 so as to be returned to an original position thereof.

Specifically, owing to the fact that the punchball 600 is rotated along a predetermined route, the user can anticipate a movement path of the punchball 600 and thus, can easily successively punch the punchball 600. This ensures that even a beginner can easily use the rotary type punching exerciser, increases the pleasure of exercise, and helps the user to get more exercise.

The support arm 100, for example, includes two first connection pipes 110 and 120. The first connection pipes 110 and 120 may be hollow pipes and may have different diameters. Thus, the two first connection pipes 110 and 120 may be coupled to each other in a telescopic manner.

In this case, a fastening member 150 may be provided between the two first connection pipes 110 and 120. The fastening member 150 may include a cylindrical body 152 coupled to a distal end of the first connection pipe 120 having a larger diameter, and an adjusting bolt 154 screwed to the body 152 to press one side of the first connection pipe 110 inserted into the body 152.

The fastening member 150 functions to adjust an extended length of the first connection pipe 110 and maintain the adjusted length, thus enabling adjustment in the length of the entire support arm 100.

A compressive coil spring 112 may be fitted in the center of the first connection pipe 110 having a smaller diameter. Thus, the support arm 100 is elastically flexible, which can prevent damage to the support arm 100 or the support bar 200 regardless of a direction in which the user punches the punchball 600.

A rotation ring 130 may be coupled to the other end of the support arm 100. The rotation ring 130 internally defines a through-hole 132, into which a bearing 136 may be inserted. The support bar 200 may be inserted into the bearing 136. As such, the bearing 136 is interposed between the support arm 100 and the support bar 200 to ensure smooth rotation of the support arm 100.

A nut 134 may be formed at one side of the rotation ring 130, and a bolt 122 may be formed at a distal end of the first connection pipe 120. Thus, the first connection pipe 120 and the rotation ring 130 may be separably fastened to each other.

The outer circumference of the support arm 100 may be covered with a protective cushion 700. When the support arm 100 is rotated as the user punches the punchball 600, a dangerous situation due to collision between the user and the support arm 100 may occur. The protective cushion 700 covering the outer circumference of the support arm 100 may reduce the above described risk. In this case, the protective cushion 700 may cover the entire support arm 100 or only the first connection pipe 100.

The protective cushion 700 may have a longitudinally elongated cylindrical shape to define a longitudinal through-hole 702, into which the support arm 100 may be inserted. The protective cushion 700 may be provided at a certain position thereof with a fastening hole 704 through which the adjusting bolt 154 is exposed. The protective cushion 700, for example, is made of soft elastic expandable resin.

Figure 3:
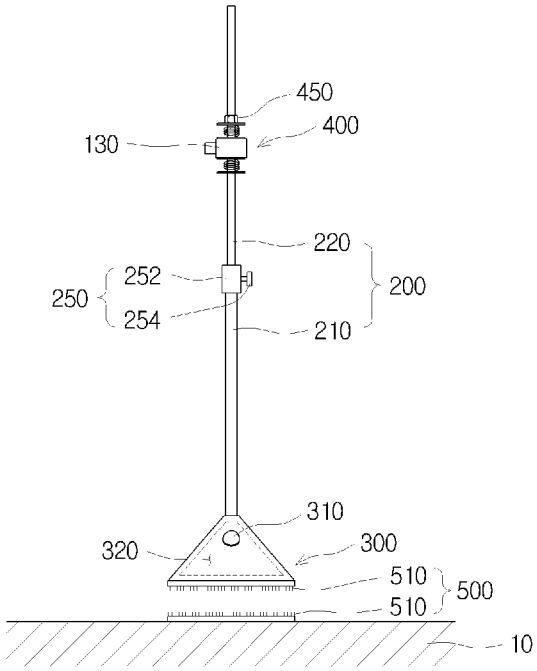
FIG. 3 is a front view illustrating a support bar and a pedestal of the rotary type punching exerciser according to the embodiment of the present invention.

FIG. 3 is a front view illustrating the support bar 200 and the pedestal 300 of the rotary type punching exerciser 1000 according to the embodiment of the present invention. As illustrated in FIGS. 2 and 3, the support bar 200 may support the support arm 100 such that the support arm 100 is horizontally rotatable by 360 degrees.

The support bar 200 may be vertically elongated. The support bar 200, for example, includes two second connection pipes 210 and 220. The second connection pipes 210 and 220 may have the same coupling relationship as the first and second connection pipes 110 and 120. Thus, a fastening member 250 may be installed between the two connection pipes 210 and 220. The fastening member 250 functions to adjust an installation height of the punchball 600.

The pedestal 300 may be coupled to a lower end of the support bar 200 to support the support bar 200. The pedestal 300 may have a conical shape and may internally define a receptacle 320 in which a weight, such as, e.g., water, is accommodated.

Thus, the pedestal 300 functions to lower the center of gravity of the rotary type punching exerciser 1000 and prevents the rotary type punching exerciser 1000 from falling over while the user punches the punchball 600.

A cover 310 may be coupled to one side of the pedestal 300 to prevent leakage of the water accommodated in the pedestal 300.

The mounting member 500 may be attached to a lower surface of the pedestal 300. The mounting member 500 assists the pedestal 300 in more stably being mounted on the floor 10. The mounting member 500 may include a pair of Velcro straps 510.

One of the Velcro straps 510, for example, may be bonded to the floor 10 using a double-sided tape, and the other Velcro strap 510 may be bonded to the lower surface of the pedestal 300. Thus, the pedestal 300 may be detachably attached to the floor 10, which allows the user to more stably and conveniently install the rotary type punching exerciser 1000 on the floor 10.

In this way, installation of the rotary type punching exerciser 1000 can be simplified, which can reduce time and costs required to install the rotary type punching exerciser 1000.

Figure 4:
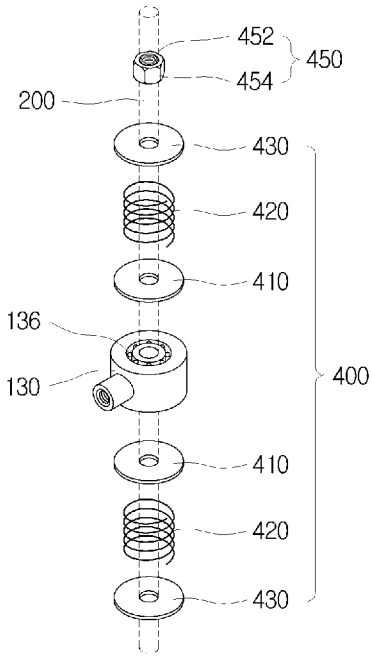
FIG. 4 is an exploded perspective view illustrating an elastic support unit of the rotary type punching exerciser according to the embodiment of the present invention.

FIG. 4 is an exploded perspective view illustrating the elastic support unit 400 of the rotary type punching exerciser 1000 according to the embodiment of the present invention. As illustrated in FIG. 4, the elastic support unit 400 may be coupled to the center of the support bar 200.

The elastic support unit 400 functions to elastically support the support arm 100 in a vertically movable manner. The elastic support unit 400 may include two sets of an elastic member 420, support plate 430, and washer 410.

The elastic member 420, for example, is a compressive coil spring. The two elastic members 420 may be arranged above and below the rotation ring 130 so as to elastically support the support arm 100 in a vertical direction. The washer 410 is interposed between the elastic member 420 and the rotation ring 130 and serves to reduce friction between the rotation ring 130 and the elastic member 420.

The two support plates 430 may be spaced apart from each other with the support arm 100 interposed therebetween and may respectively support ends of the elastic members 420.

With the use of the elastic support unit 400, the support arm 100 may be rotatably and vertically movably coupled to the support bar 200. Thus, the support arm 100 is vertically movable if the user punches the punchball 600 upward or downward, which can prevent damage to the support arm 100 or the support bar 200.

An adjustor 450 may be rotatably coupled to the support bar 200. The rotation speed of the adjustor 450 may be adjusted by adjusting the magnitude of friction between the support arm 100 and the support bar 200, which enables adjustment in the rotation cycle of the punchball 600.

One of the support plates 430 to support the bottom of the rotation ring 130 may be secured to the support bar 200, whereas the other support plate 430 placed on the rotation ring 130 may be vertically movably coupled to the support bar 200. In this case, the adjustor 454 may include screw threads 452 formed at the outer circumference of the support bar 200 and an adjusting screw 454 fastened to the screw threads 452.

The user can adjust elastic restoration force of the elastic members 420 pressing the rotation ring 130 by rotating the adjusting screw 454, thereby adjusting the rotation speed of the support arm 100. This changes the rotation cycle of the punchball 600, enabling adjustment in the resilience speed of the punchball 600. In this way, the user can adjust a punching cycle of the punchball 600 using the adjusting screw 454.

Figure 5:
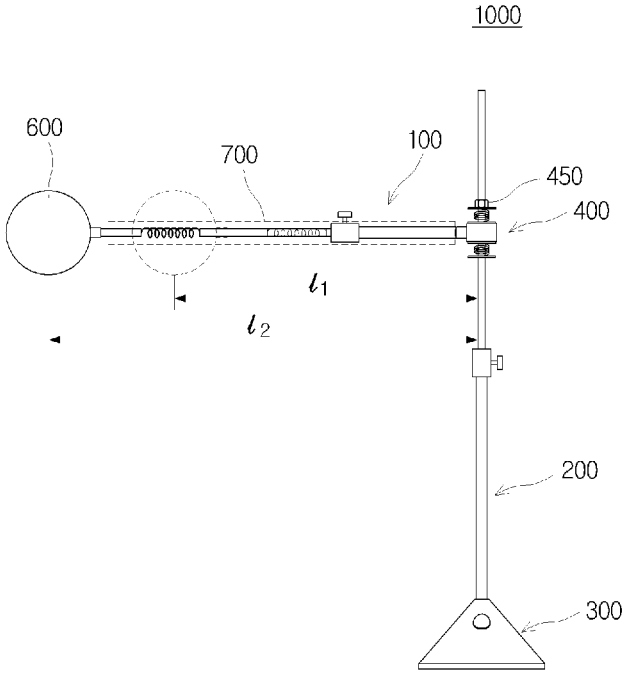
FIGS. 5 and 6 are front views illustrating the rotary type punching exerciser according to the embodiment of the present invention.
Figure 6:
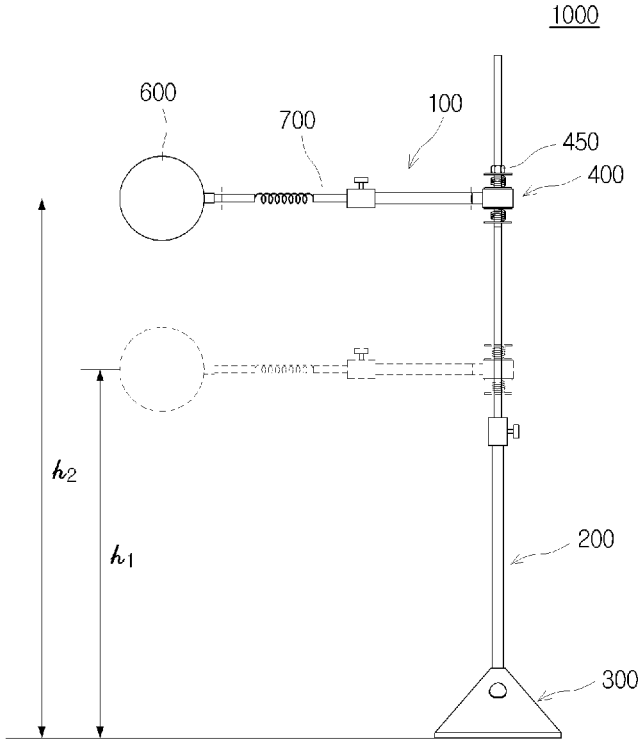

FIGS. 5 and 6 are front views illustrating the rotary type punching exerciser 1000 according to the embodiment of the present invention. As illustrated in FIG. 5, the support arm 100 has a horizontally adjustable length to enable a distance between the punchball 600 and the support bar 200 to be adjusted.

If a distance between the punchball 600 and the support bar 200 is short ($l_1$ of FIG. 5), the rotation cycle of the punchball 600 is reduced, allowing the user to more rapidly punch the punchball 600. On the other hand, if a distance between the punchball 600 and the support bar 200 is long ($l_2$ of FIG. 5), the rotation cycle of the punchball 600 is increased, allowing the user to more slowly punch the punchball 600. As such, the user can adjust the punching cycle of the punchball 600 by adjusting the length of the support arm 100.

As illustrated in FIG. 6, the support bar 200 has a vertically adjustable length to enable an installation height of the punchball 600 to be adjusted.

If the punchball 600 is installed at a low height from the floor ($h_1$ of FIG. 6), a short user, such as a child, may practice punching using the fist, or may practice other ball games using the foot.

Also, if the punchball 600 is installed at a high height from the floor ($h_2$ of FIG. 6), a tall user may practice punching using the fist, such as in boxing, or may practice kicking or volleyball. As such, adjusting the length of the support bar 200 allows users of various age groups to practice various punching motions.

Figure 7:
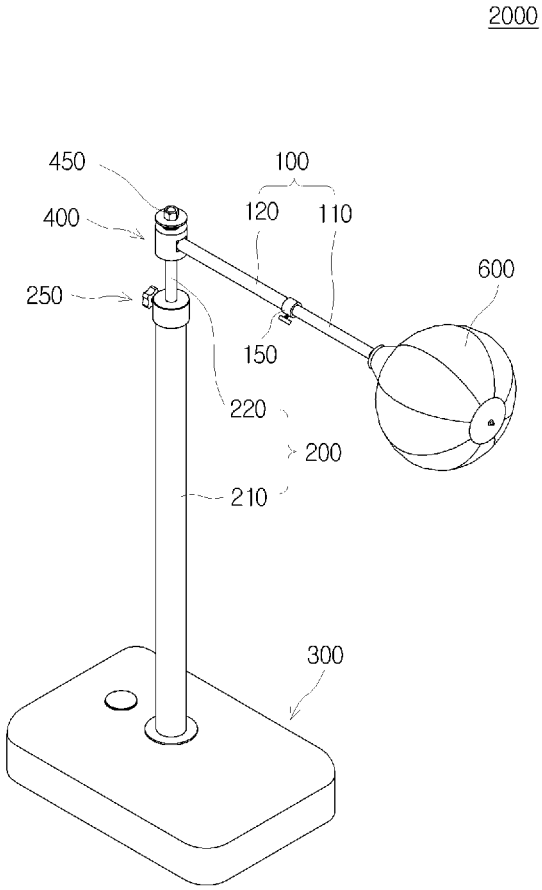
FIG. 7 is a perspective view illustrating a rotary type punching exerciser according to another embodiment of the present invention.

FIG. 7 is a perspective view illustrating a rotary type punching exerciser 2000 according to another embodiment of the present invention. As illustrated in FIG. 7, the rotary type punching exerciser 2000 of the present embodiment includes a rectangular parallelepiped pedestal 300, which provides the rotary type punching exerciser 2000 with an increased support area of a lower surface with respect to the floor, allowing the user to stably practice punching motions.

The pedestal 300 is charged with water to realize a stable support structure owing to an increased weight thereof.

Figure 8:
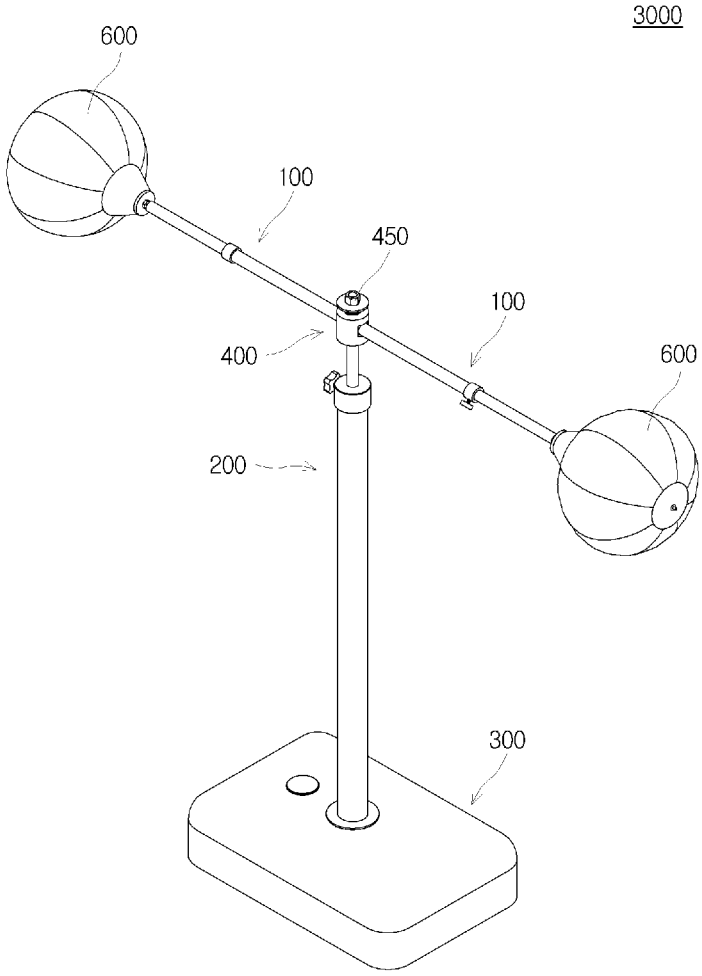
FIG. 8 is a perspective view illustrating a rotary type punching exerciser according to another embodiment of the present invention.

FIG. 8 is a perspective view illustrating a rotary type punching exerciser 3000 according to another embodiment of the present invention. As illustrated in FIG. 8, the rotary type punching exerciser 3000 of the present embodiment includes a pair of support arms 100 coupled to opposite sides of the support bar 200, each of which is provided at a distal end thereof with the punchball 600.

Allowing the user to punch the two punchballs 600 may reduce the rotation cycle of the punchball 600 by half, which allows the user to use the rotary type punching exerciser 3000 at a shorter punching cycle.

Figure 9:
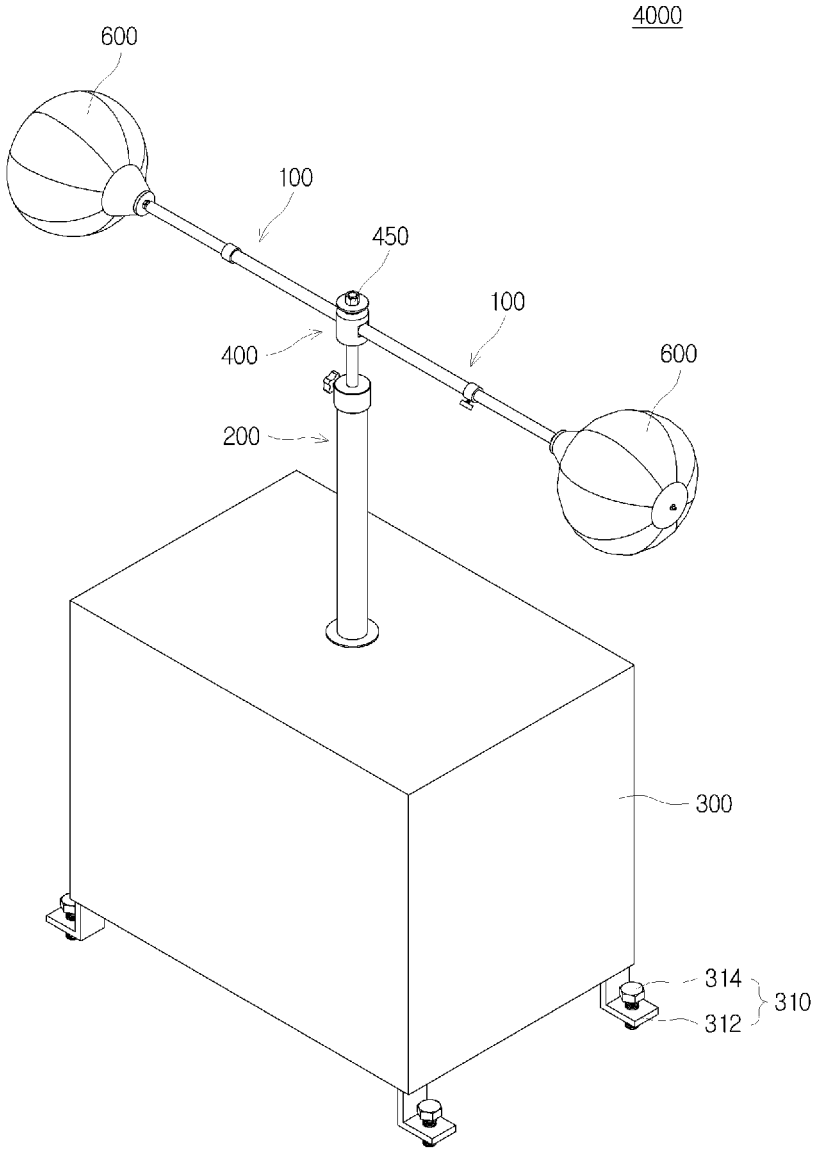
FIG. 9 is a perspective view illustrating a rotary type punching exerciser according to a further embodiment of the present invention.

FIG. 9 is a perspective view illustrating a rotary type punching exerciser 4000 according to a further embodiment of the present invention. As illustrated in FIG. 9, the rotary type punching exerciser 4000 of the present embodiment includes an increased size of the rectangular parallelepiped pedestal 300, in addition to the two punchballs 600 similar to the above described rotary type punching exerciser 3000 of FIG. 8. The rotary type punching exerciser 4000 using the increased size of the pedestal 300 may have a theft-proof function.

The pedestal 300 may be made of steel and may be charged with cement mortar. Also, the pedestal 300 may be provided at a lower surface thereof with mounting members 310, and each mounting member 310 may include a support leg 312 and a mounting screw 314. The support leg 312 is coupled to each corner of the lower surface of the pedestal 300 and a through-hole may be formed in each support leg 312. The mounting screw 314 may be inserted into the through-hole and be fixed to the floor 10 using, e.g., cement mortar.

The rotary type punching exerciser 4000 of the present embodiment has a stable installation configuration with respect to the floor and has a theft-proof function.

As is apparent from the above description, the present invention provides a rotary type punching exerciser in which a punchball is rotated along a predetermined route, allowing a user to anticipate a movement path of the punchball and successively punch the punchball.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A rotary type punching exerciser comprising:

a punchball;

a support arm to support the punchball, the support arm being adjustable in length in a direction in which one end of the support arm extends to enable adjustment of a punching cycle of the punchball;

a support bar to support the other end of the support arm such that the support arm is rotatable by 360 degrees, the support bar being adjustable in length in a vertical direction to enable adjustment of a punching height of the punchball;

a pedestal to support the support bar; and an elastic support unit to elastically support the support arm in a direction in which the support bar extends, wherein the elastic support unit includes:

support plates coupled to upper and lower positions of the support bar with the support arm interposed therebetween;

an elastic member interposed between each support plate and the other end of the support arm; and a washer interposed between the elastic member and the support arm.

2. The exerciser according to claim 1, wherein the other end of the support arm is provided with a rotation ring into which the support bar is inserted, and wherein both ends of the support arm are separably coupled to the punchball and the rotation ring.

3. The exerciser according to claim 1, wherein the support arm is elastically flexible.

4. The exerciser according to claim 1, wherein the pedestal internally defines a receptacle in which a weight is accommodated.

5. The exerciser according to claim 1, further comprising a mounting member coupled to a lower surface of the pedestal, wherein the mounting member includes a pair of Velcro straps interposed between the pedestal and the floor on which the rotary type punching exerciser is installed.

6. A rotary type punching exerciser comprising:

a punchball;

a support arm to support the punchball;

a support bar to support the support arm such that the support arm is rotatable by 360 degrees;

a pedestal to support the support bar; and an elastic support unit to elastically support the support arm in a direction in which the support bar extends, wherein the elastic support unit includes:

support plates coupled to upper and lower positions of the support bar with the support arm interposed therebetween;

an elastic member interposed between each support plate and one end of the support arm; and a washer interposed between the elastic member and the support arm.

7. The exerciser according to claim 6, wherein the support arm is adjustable in length and in a direction in which the support arm extends to enable adjustment of a punching cycle of the punchball.

8. The exerciser according to claim 6, wherein the support bar is adjustable in length and in a vertical direction to enable adjustment of a punching height of the punchball.

9. A rotary type punching exerciser comprising:

a punchball;

a support arm to support the punchball;

a support bar to support the support arm such that the support arm is rotatable by 360 degrees;

a pedestal to support the support bar;

an adjustor to adjust a rotation cycle of the support arm about the support bar to enable adjustment of a punching cycle of the punchball; and an elastic support unit to elastically support the support arm in a direction in which the support bar extends, wherein the elastic support unit includes:

support plates coupled to upper and lower positions of the support bar with the support arm interposed therebetween;

an elastic member interposed between each support plate and one end of the support arm; and a washer interposed between the elastic member and the support arm.

10. The exerciser according to claim 9, wherein the end of the support arm is provided with a rotation ring, into which the support bar is inserted, and wherein the adjustor includes an adjusting screw fastened to the support bar so as to press the support plate toward the rotation ring.

11. The exerciser according to claim 10, wherein the support arm is adjustable in length and in a direction in which one end of the support arm extends to enable adjustment of a punching cycle of the punchball.

12. The exerciser according to claim 11, wherein the support bar is adjustable in length and in a vertical direction to enable adjustment of a punching height of the punchball.

* * * * *